United States Patent [19]

Stewart

[11] Patent Number: 4,598,935

[45] Date of Patent: Jul. 8, 1986

[54] BUSINESS FORM WITH PACKING LABEL AND METHOD OF USE

[76] Inventor: Gary E. Stewart, 4050 E. Rancho, Phoenix, Ariz. 85018

[21] Appl. No.: 466,035

[22] Filed: Feb. 14, 1983

[51] Int. Cl.[4] ..... B42D 15/00; B41L 1/20; B65D 27/00

[52] U.S. Cl. ..... 283/81; 282/9 R; 229/74

[58] Field of Search ..... 283/81, 80; 282/25, 282/9 R, 9 A, 23 R, 29; 229/74

[56] References Cited

U.S. PATENT DOCUMENTS

| | | | |
|---|---|---|---|
| 2,648,924 | 8/1953 | Brewster | 283/81 |
| 3,854,229 | 12/1974 | Morgan | 283/81 |
| 3,987,960 | 10/1976 | Gardiner | 282/25 |
| 4,121,961 | 10/1978 | Brunette | 283/81 |
| 4,150,183 | 4/1979 | Reed | 283/81 |
| 4,153,163 | 5/1979 | Alderman et al. | 282/25 |
| 4,159,586 | 7/1979 | Blum | 283/81 |
| 4,204,706 | 5/1980 | Blum et al. | 283/81 |
| 4,211,435 | 7/1980 | Reese | 282/25 |

*Primary Examiner*—Robert L. Spruill
*Assistant Examiner*—Paul M. Heyrana, Sr.
*Attorney, Agent, or Firm*—Drummond & Nissle

[57] ABSTRACT

An improved business form. One of the pages of the business form is adapted to be used to form a pre-addressed mailing pouch on a shipping container.

5 Claims, 4 Drawing Figures

BUSINESS FORM WITH PACKING LABEL AND METHOD OF USE

This invention relates to business forms.

More particularly, the invention pertains to an improved business form having a plurality of stacked, joined, separable sheets each having a front side and a back side, the business form being constructed such that when the form is against a support surface and a name and address are inscribed on the front side of one of the uppermost sheets of the form, localized pressure applied to the business form during the inscription process causes the name and address to be reproduced on the front side of at least some of the other sheets of the business form.

In a further respect, the invention pertains to a business form of the type described in which one of the sheets having the name and address formed on the front side during the inscription process is a packing slip normally inserted with goods in a container before the container is sealed and shipped.

In a further respect, the invention pertains to a business form of the type described in which one of the sheets having the name and address formed on the front side during the inscription process is adapted to be separated from the business form, attached to a container, and used as a pre-addressed mailing pouch; the specially adapted mailing pouch sheet being provided with adhesive on its back surface and with backing material which can be separated from the back surface of the sheet to expose a substantially continuous adhesive strip, the exposed adhesive strip inscribing an area on the back surface of the mailing pouch sheet.

In still another respect, the invention pertains to a business form of the type described in which the mail pouch sheet is separated from the business form; the backing material partially removed therefrom to expose a portion of the adhesive strip; the exposed adhesive pressed against a container to secure the mailing pouch sheet in position thereon; the packing slip is removed from the business form and inserted between the container and mail pouch sheet in the area generally inscribed by the adhesive strip; the backing material is completely removed from the back of the mail pouch sheet to expose the remainder of the adhesive strip; and, the remainder of the adhesive strip is pressed against the container to enclose the packing slip between the mail pouch sheet and container.

Multiple sheet business forms are widely used in commerce in connection with the ordering, sale and distribution of goods. Most or all of the sheets in such business forms are often provided with blocks for inscribing the name and address of the purchaser and the name and address of the entity to which the goods noted on the business forms are to be shipped. Each pair of adjacent sheets is typically interleaved with a carbon sheet so that when the name and address of the purchaser or of the entity to which the goods are to be shipped is inscribed on the first sheet, the name and address are reproduced in address blocks on other sheets in the form. To avoid having to interleave paper sheet pairs with carbon sheets, business forms sometimes include sheets of paper or other material which react to localized pressure applied to the form such that when a name and address are inscribed on the front sheet of the form the name and address are simultaneously formed and reproduced on sheets of the business form behind the front sheet. Thus, carbon sheets or pressure sensitive paper sheets permit the user of the form to automatically address most or all of the sheets in the form by simply writing the name and address of a purchaser on the front sheet of the form.

The sheets in a business form are typically rectangular or square, of equal size, stacked so the edges of each sheet conform to one another, and are glued or otherwise joined along at least one edge. Each sheet is usually perforated near its joined edge so it can be individually removed from the form. As earlier noted, each sheet is normally provided with address blocks in which the name and address of the purchaser and of the entity receiving the goods can be inscribed. The address blocks are at the same general location on each sheet of the business form so that while a name and address is being entered on the first sheet, it is simultaneously reproduced (via carbon paper or pressure sensitive paper) on at least some of the other sheets in the form. The form also includes blocks for listing the quantity, price and other information concerning the goods purchased. The first sheet of the form is often labeled the invoice copy, the second sheet the office copy, the third sheet the packing list, and the fourth sheet the salesman's copy. The invoice copy is utilized to bill the purchaser, the office copy maintained in the files of the seller, the packing list shipped with the goods and the salesman's copy retained by the salesman. If desired, additional sheets may be added to the form or fewer sheets utilized. Sometimes the packing list is not a part of the business form but is completed separately from the business form.

When a business form of the general type described above is utilized, the packing list will be inserted in the container in which the purchased goods are shipped. In addition, a separate mailing label is prepared and attached to the container. One disadvantage with this procedure is that when the customer receives the container, the packing slip is sometimes not readily located. Further, the cumulative amount of time spent individually addressing business forms, container mailing labels, and, sometimes, packing lists, can be substantial.

Therefore, it would be highly desirable to provide an improved business form which would, when completed and addressed by the seller of goods, provide both a packing list and a pre-addressed mailing pouch which could be attached to a container and carry the packing list therein.

Therefore, it is a principal object of the invention to provide an improved business form.

A further object of the invention is to provide an improved business form having a plurality of stacked, joined, separable sheets each having a front side and a back side, the business form being constructed such that when the form is against a support surface and a name and address are inscribed on the front side of the first sheet of the form, localized pressure applied to the business form during the inscription causes the name and address to be reproduced on the front side of at least some of the other sheets of the business form.

Another object of the instant invention is to provide an improved business form of the type described in which one of the sheets having the name and address formed on the front side during the inscription process is a packing list normally inserted with the goods listed thereon in a container before the container is sealed and shipped.

Still a further object of the invention is to provide an improved business form of the type described in which one of the sheets having the name and address formed on the front side during the inscription process is adapted to be separated from the business form, attached to a container, and used as a pre-addressed mailing pouch.

These and other, further and more specific objects and advantages of the invention will be apparent to those skilled in the art from the following detailed description thereof, taken in conjunction with the drawings, in which.

Briefly, in accordance with the invention, I provide an improved business form. The business form includes a plurality of separable, stacked, joined sheets each having a front side and a back side and is constructed such that when the business form is against a support surface and a name and address is inscribed on one of the sheets, localized pressure applied to the business form during the inscription causes the name and address to be reproduced on the front side of at least some of the other sheets comprising the business form. The back side of one of the sheets having the name and address formed thereon during said inscription is provided with adhesive on at least a portion thereof and with backing material covering the back of the sheet and being peelable and separable therefrom such that a substantially continuous strip of adhesive is exposed.

Figure 1:
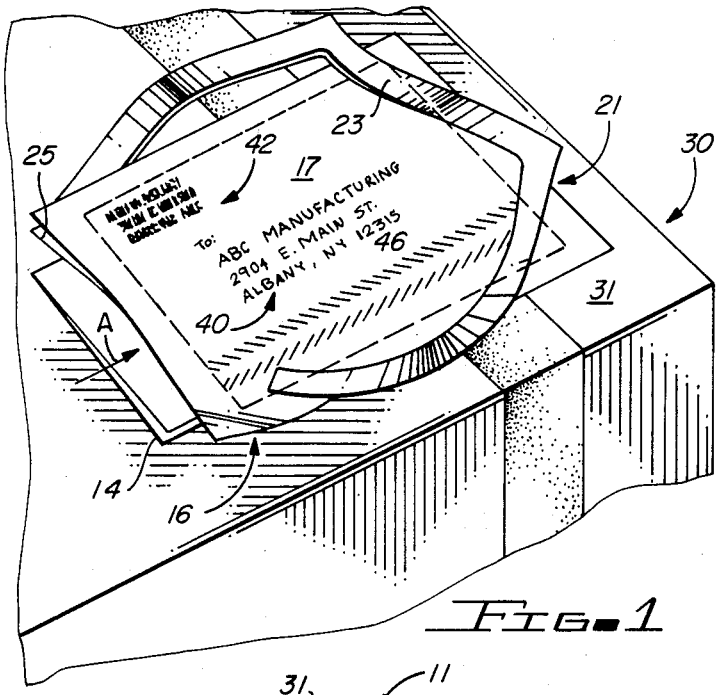
FIG. 1 is a partial perspective view of a container illustrating the utilization of a sheet from a business form adapted in accordance with the principles of the invention to form a mailing pouch on the container.
Figure 4:
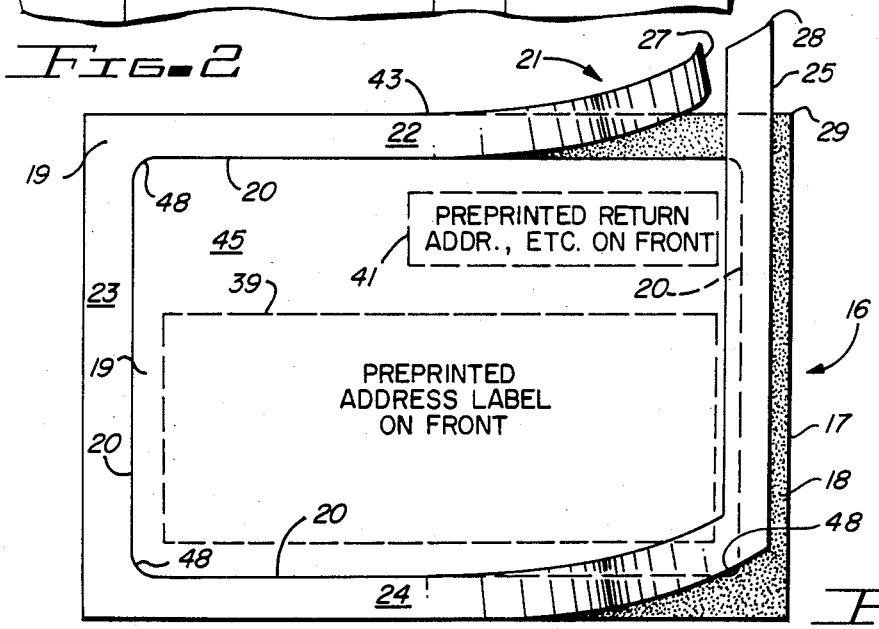
FIG. 4 is a back view of the mailing pouch sheet of the business form of FIG. 2.

Turning now to the drawings, which depict the presently preferred embodiment and best mode of the invention for the purpose of illustrating the practice thereof and not by way of limitation of the scope of the invention, and in which like reference characters correspond to identical elements throughout the several views, FIG. 1 illustrates a business form constructed in accordance with the principles of the invention generally indicated by reference character 11. Form 11 includes invoice copy sheet 12, office copy sheet 13, packing list sheet 14, salesman's copy 15 and mail pouch or packing label sheet 16. Sheet 16 includes paper sheet 17 having adhesive layer 18 on the entire back surface thereof. Sheet 19 of backing material protects adhesive layer 18. Backing 19 is die cut along line 20 to form center section 45 and strip 21 having sections 22 to 25. As shown in FIG. 4, sections 22, 23, 24 and 25 of strip 21 are interconnected so strip 21 can be peeled off from adhesive 18 as a single piece. Strip 22 is die cut along edge 27 so that when strip 21 is being removed from the back of sheet 17, edge 27 may be peeled away from adhesive 18 without having to simultaneously peel end 28 of section 25 away from the adhesive 18. If desired, when removing strip 21 from the back of sheet 16, end 28 may be separated from adhesive 18 first, then sections 25, 24, 23 and 22. When edge 27 is initially peeled away from adhesive 18, strip 21 is removed from the back of sheet 16 by first peeling away section 22 and then sections 23, 24, 25 in that order. When sheet 16 is being manufactured, corner 29 of sheet 17 may be bent or dog-eared away from corner 28 of section 25 of strip 21 so that an individual may, after removing sheet 16 from form 11, readily grasp and begin to peel end 28 from adhesive 18 and sheet 17.

Figure 2:
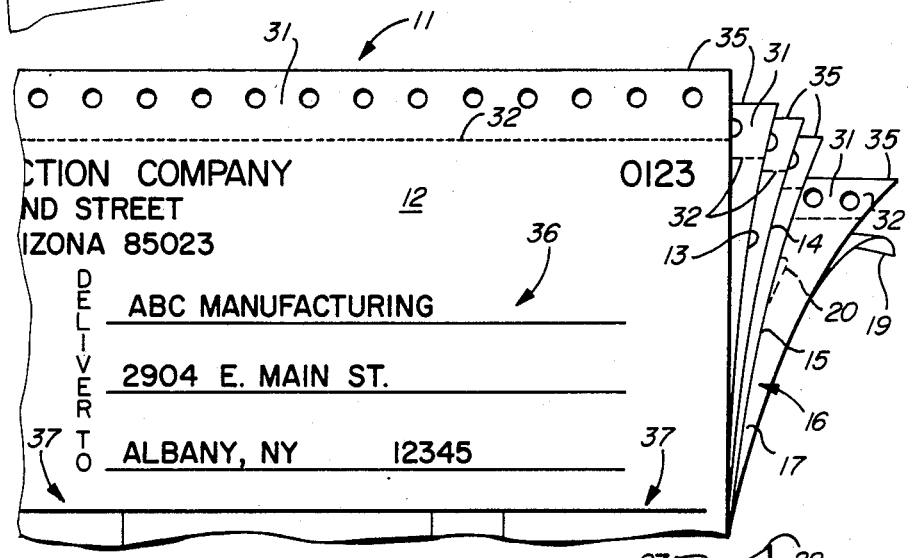
FIG. 2 is a partial perspective view of a business form, the final sheet of which is adapted in accordance with the invention such that an addressed mailing pouch can be formed therefrom on a container as shown in FIG. 1.

In FIG. 2, sheets 12–15, 17 can each be manufactured from a different color of paper so that a salesperson utilizing form 11 can distinguish the sheets from one another. Sheets 13–15, 17 are cut from a type of paper which forms a dark image when pressure is applied through sheet 12 and against sheets 13–15 or 17. Instead of utilizing such pressure sensitive paper, sheets 12–15, 17 could be cut from ordinary sheets of paper and sheets of carbon could be interleaved between sheets 12, 13; 14, 15; and 15, 17. Thus, if either pressure sensitive paper or regular paper in combination with interleaved sheets of carbon paper is utilized, when a name and address is inscribed on the front page 12 of form 11 the name and address is reproduced on pages 13–15, 17 of the form. Form 11 could include one or more sheets on which it was not desired to reproduce the address inscribed on sheet 12. For example, to avoid forming the address on sheet 15, a carbon copy would be omitted from between sheets 14, 15 and sheet 15 would not be cut from pressure sensitive paper stock.

Top edge strips 31 of each sheet 12–16 are glued together to form form 11. Each sheet can be separated from form 11 along perforated line 32. In some business forms, perforation lines 32 are not provided and the sheets are simply peeled apart along top edge strips 31. This is particularly the case when the individual sheets are bound together like a paperback book by being glued with a rubber gum resin along upper edges 35. Sheets 12–16 are generally square or rectangular, of equal size, and are stacked so that the peripheral rectangular edge of each sheet generally corresponds with the edges of the other sheets. However, each sheet of form 11 may be of a size different from and overlap one or more of the other sheets of the form. Some business forms overlap one another or are joined along more than one edge. A business form can, when appropriate, be of some shape other than rectangular or square and be joined with staples or any other binding means.

In addition to the "Deliver To" address block shown in FIG. 2, business forms often include a separate block for inserting the name and address of a purchaser. Both the "Deliver To" address block and the purchaser address block, if there is one, are normally reproduced on sheets 13, 14 and 15 in the same general location as and directly beneath the address blocks on sheet 12. Thus, when an address block on sheet 12 is completed, either manually or with a machine, the address inscribed on sheet 12 is reproduced on sheets 13, 14, 15. Sheet 16 is, as indicated in FIG. 2, positioned directly behind the upper right hand corners of stacked sheets 12–15. In FIG. 2, sheet 17 of sheet 16 is cut from pressure sensitive paper and is large enough so that when the "ABC Manufacturing" address is inscribed in the "Deliver To" block 36 on sheet 12, the localized pressure bearing through sheet 12 and against sheets 13–15, 17 causes the "ABC Manufacturing" address to be reproduced within the address block on the front of sheet 17 indicated by dashed line 39 in FIG. 4. The reproduced "ABC Manufacturing" address 40 is shown in FIG. 1 on the front side of sheet 17. The front side of sheet 17 can be provided with a preprinted return address in the block indicated by dashed line 41 in FIG. 4. Such a return address 42, which is usually printed on sheet 17 before form 11 is assembled, is indicated on sheet 17 in FIG. 1.

Packing label or mailing pouch sheet 16 is of sufficient size and is positioned in business form 11 such that the "Deliver To" or other appropriate address is, when inscribed on one of sheets 12–15, reproduced on sheet 16. Mail pouch sheet 16 is, in the embodiment of the invention shown in FIGS. 1, 2, and 4, smaller than sheets 12–15. However, sheet 16 could be of the same size as or larger than one or more of the other sheets in form 11. Further, sheet 16 could be smaller than other sheets in form 11, but be a part of another sheet which could be smaller than, equal in size to, or larger than other sheets in form 11.

The upper edge 43 of sheet 16 in FIG. 4 is formed by detaching sheet 16 from upper edge 31 along perforated lines 32. If sheet 16 were part of a mail pouch sheet attached to the back of form 11, perforations could be formed in the mail pouch sheet so that sheet 16 of FIGS. 1, 4 could be torn from the mail pouch sheet and the remainder of the mail pouch sheet discarded. Sometimes it is simpler to make the mail pouch sheet the same size as other sheets in form 11 and provide perforated lines in the mail pouch sheet so sheet 16 can be detached therefrom.

The back of sheet 16 is, as earlier described, coated with a layer of adhesive 18 and with peelable backing 19 covering adhesive layer 18. Backing 19 includes strip 21 and rectangular center section 45. Although the presently preferred embodiment provides sheet 17 having the entire back side covered with adhesive layer 18, the back side of sheet 17 could simply be provided with a substantially continuous strip of adhesive generally corresponding in size, shape and dimension to paper strip 21. A strip of backing material or whole sheet of backing material could be placed over such an adhesive strip. Since when the backing material is removed it is only necessary that a strip of adhesive around the periphery and inner area of the back of sheet 17 be exposed, adhesive does not have to cover the entire back surface of sheet 17.

Mail pouch sheet 16 does not have to be the last sheet of form 11 and can be the first, second, etc. sheet in the form.

Figure 3:
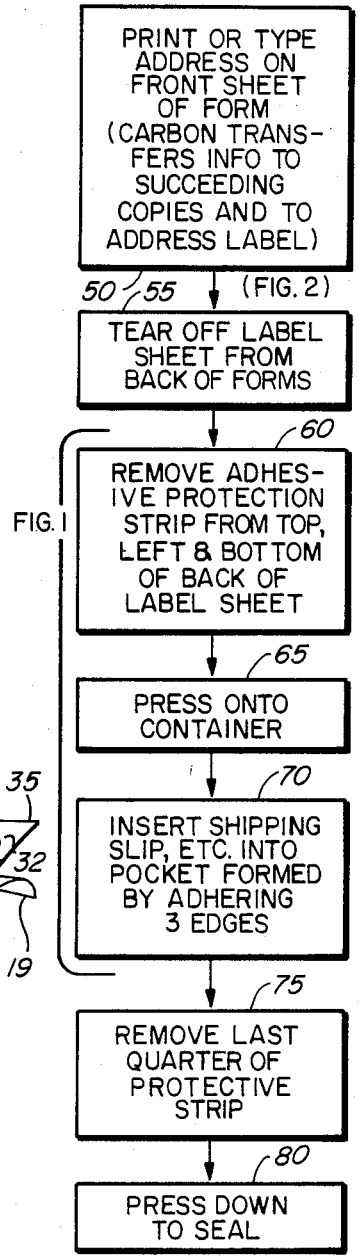
FIG. 3 is a flow chart depicting the use of the business form of FIG. 2.

In use (See FIG. 3), the name and address of the purchaser or shipping recipient is printed 50 on one of sheets 12–15 along with a description of the goods in areas 37. When the name and address are inscribed on one of sheets 12–15, the localized pressure against one of sheets 12–15 and, consequently, against sheet 17, causes the name and address to be reproduced on sheet 16 in the label area lying with dashed line 39. After business form 11 has been completely filled out, sheet 16 is detached 55 from form 11 along perforated line 32 adjacent edge 31 and backing strip segments 22, 23, 24 of strip 21 are peeled 60 from adhesive 18. If desired only segment 22 or segments 22, 23 need initially be peeled from adhesive 18. The adhesive exposed after segments 22–24 (or segment 22, etc.) are removed from the back of sheet 17 is, as shown in FIG. 1, pressed 65 against container 30 to secure packing label 16 in position on surface 31. Shipping list sheet 14 is then removed from form 11, folded and inserted 70 between mail pouch sheet 16 and surface 31 of container 30 as indicated by arrow A in FIG. 1. Shipping list 14 can be a sheet which is not included in and is prepared separately from form 11. After slip 14 is inserted between packing label 16 and surface 31, segment 25 is peeled 75 from adhesive 18 to completely remove backing 21 from sheet 17. The exposed adhesive which was behind segment 25 is then pressed 80 against surface 31 to generally completely enclose slip 14 between pouch 16 and surface 31. Center section 45 of backing 19 is never removed from adhesive 18. As would be appreciated by those of skill in the art, the adhesive exposed when strip 21 is removed does not have to be a continuous strip as indicated in FIGS. 2 and 4, but could be comprised of a plurality of space segments of adhesive sufficient to maintain sheet 17 in contact with surface 31 and to maintain packing slip 7 14 secured in position between sheet 16 and surface 31 of container 30. Such spaced segments of adhesive would generally tend to inscribe and enclose an area on the back surface of sheet 17.

Zipper 46 is formed by making a plurality of short, spaced, parallel cuts through sheet 17 and backing 17. Zipper 46 permits packing list 19 to be readily removed from between mail pouch 16 and surface 31 of container 30.

In FIG. 4, the radii 48 formed along die cut line 20 facilitate the peeling of strip 21 from adhesive 18. If square corners were utilized instead of radii 48, section 22 would tend to tear apart from section 23 when strip 21 was removed from adhesive 18.

Having described my invention in such terms as to enable those skilled in the art to which it pertains to understand and practice it, and having described the presently preferred embodiments thereof, I claim:

1. A business form comprising a plurality of bound stacked leaves each having a front side and back side, said form including (a) a detachable shipping leaf having
  (i) an information recordation area on the front side thereof for describing goods being processed with said form, and
  (ii) an address space on the front side thereof for the name and address of the customer requisitioning said goods; and, (b) a detachable mailing pouch leaf having
  (i) an address space on the front side thereof for the name and address of the customer requisitioning said goods, and
  (ii) a strip of adhesive on the back side thereof generally circumscribing
    said address space on said front side, and
    an adhesive free surface on said back side of said mailing pouch leaf, one of said address spaces on said shipping and mailing pouch leaves being positioned generally directly above the other of said address spaces, said plurality of bound, stacked leaves comprising said business form being fabricated such that while said business form is contacting a support surface and localized pressure is applied to said business form to complete and inscribe information on said form,
  a name and address are simultaneously produced in said address spaces of said shipping and mailing pouch leaves, and
  a description of said goods is produced in said information recordation area of said shipping leaf, said shipping leaf and mailing leaf being detached from said business form after said form is completed and said mailing pouch leaf being attached with said adhesive strip to the surface of a shipping container for said goods with said shipping leaf positioned and maintained between and contacting said container surface and said adhesive free surface of said back side of said mailing pouch leaf, and generally circumscribed by said adhesive strip of said mailing pouch leaf.

2. The business form of claim 1 wherein said adhesive is pressure sensitive.

3. The business form of claim 2 including detachable backing material covering said pressure sensitive adhesive strip, said backing material being at least partially peeled from said mailing pouch leaf prior to said adhesive strip being pressed against said surface of said container to attach said mailing pouch leaf thereto.

4. The business form of claim 3 including a detachable invoicing leaf having (a) an address space on the front side thereof for the name and address of the customer requisitioning said goods, and (b) an information recordation area on the front side thereof for describing goods being processed with said form, two of said address spaces on said shipping, invoicing and mail pouch leaves being positioned generally directly above the remaining one of said address spaces, one of said information recordation areas on said shipping and invoicing leaves being positioned generally directly above the other of said information recordation areas, said plurality of bound, stacked leaves comprising said business form being fabricated such that while said business form is contacting a support surface and localized pressure is applied to said business form to complete and inscribe information on said form, a name and address are simultaneously produced in said address spaces of said shipping, invoicing and mailing pouch leaves, and a description of said goods is produced in said information recordation areas of said shipping and invoicing leaves.

5. A method of preparing goods for shipment to a customer, including the steps of (a) inscribing a description of the goods and the name and address of the customer on a business form, the business form comprising a plurality of bound stacked leaves each having a front side and a back side, said form including (i) a detachable shipping leaf having an information recordation area on the front side thereof for describing goods being processed with said form, and an address space on the front side thereof for the name and address of the customer requisitioning said goods; and, (ii) a detachable mailing pouch leaf having an address space on the front side thereof for the name and address of the customer requisitioning said goods, and a strip of adhesive on the back side thereof generally circumscribing said address space on said front side, and an adhesive free surface on said back side of said mailing pouch leaf, one of said address spaces on said shipping and mailing pouch leaves being positioned generally directly above the other of said address spaces, said plurality of bound, stacked leaves comprising said business form being fabricated such that while said business form is contacting a support surface and localized pressure is applied to said business form to complete and inscribe information on said form, a name and address are simultaneously produced in said address spaces of said shipping and mailing pouch leaves, a description of said goods is produced in said information recordation area of said shipping leaf, said shipping leaf and mailing pouch leaf being detached from said business form after said form is completed and said mailing pouch leaf being attached with said adhesive strip to the outer surface of a shipping container for said goods with said shipping leaf positioned and maintained between and contacting said container surface and said adhesive free surface of said back side of said mailing pouch leaf, and generally circumscribed by said adhesive strip of said mailing pouch leaf, and (b) providing a shipping container having an outer surface;

(c) detaching said shipping leaf and mailing pouch leaf from said business form; and, (d) attaching said mailing pouch leaf to said outer surface of said container with said adhesive strip on said back side of said mailing pouch leaf with said shipping leaf (i) positioned and maintained between and contacting said container surface and said adhesive free surface on said back side of said mailing pouch leaf, and (ii) generally circumscribed by said adhesive strip on said back side of said mailing pouch leaf.

* * * * *